US011060801B2

(12) United States Patent
Alahyari et al.

(10) Patent No.: US 11,060,801 B2
(45) Date of Patent: Jul. 13, 2021

(54) MICROTUBE HEAT EXCHANGER

(71) Applicant: Carrier Corporation, Farmington, CT (US)

(72) Inventors: Abbas A. Alahyari, Manchester, CT (US); John H. Whiton, South Windsor, CT (US); Matthew Robert Pearson, Hartford, CT (US); Jack Leon Esformes, Jamesville, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 169 days.

(21) Appl. No.: 15/580,221

(22) PCT Filed: Jun. 28, 2016

(86) PCT No.: PCT/US2016/039854

§ 371 (c)(1),
(2) Date: Dec. 6, 2017

(87) PCT Pub. No.: WO2017/004061

PCT Pub. Date: Jan. 5, 2017

(65) Prior Publication Data

US 2018/0164045 A1 Jun. 14, 2018

Related U.S. Application Data

(60) Provisional application No. 62/186,111, filed on Jun. 29, 2015.

(51) Int. Cl.
*F28F 1/02* (2006.01)
*F28D 1/053* (2006.01)

(52) U.S. Cl.
CPC ..... *F28F 1/022* (2013.01); *F28D 1/05383* (2013.01); *F28F 2250/02* (2013.01); *F28F 2260/02* (2013.01)

(58) Field of Classification Search
CPC .... F28F 1/022; F28F 2250/02; F28F 2260/02; F28D 1/05383
(Continued)

(56) References Cited

U.S. PATENT DOCUMENTS 4,615,384 A 10/1986 Shimada et al.
RE33,528 E * 1/1991 Doty ..... F28D 7/1653 165/158
(Continued)

FOREIGN PATENT DOCUMENTS

EP 0219974 A2 4/1987
EP 0539638 A1 5/1993
(Continued)

OTHER PUBLICATIONS

Aluminium Brazing, [online]; [retrieved on Dec. 5, 2017]; retrieved from the Internethttp://www.aluminium-brazing.com/tag/exchanger/page/2/Aluminium Brazing, "Brazing of Aluminium Alloys with Higher Magnesium Content using Non-Corrosive Fluxes—Part 1," Aluminium Brazing, Mar. 26, 2014, pp. 1-30.
(Continued)

*Primary Examiner* — Joel M Attey
(74) *Attorney, Agent, or Firm* — Cantor Colburn LLP

(57) ABSTRACT

A heat exchanger is provided including an inlet manifold and an outlet manifold arranged generally parallel to the inlet manifold and being spaced therefrom by a distance. A plurality of rows of microtubes is aligned in a substantially parallel relationship. The plurality of rows of microtubes is configured to fluidly couple the inlet manifold and the outlet manifold. Each of the plurality of rows includes a plurality of microtubes.

11 Claims, 7 Drawing Sheets

(58) Field of Classification Search
USPC ..... 165/173
See application file for complete search history.

(56) References Cited

U.S. PATENT DOCUMENTS

| | | | | |
|---|---|---|---|---|
| 5,186,022 | A | 2/1993 | Kim | |
| 5,289,874 | A | 3/1994 | Kadle et al. | |
| 5,797,451 | A | 8/1998 | Grant | |
| 6,209,628 | B1 | 4/2001 | Sugimoto et al. | |
| 6,286,590 | B1 | 9/2001 | Park | |
| 6,918,435 | B2 | 7/2005 | Dwyer | |
| 7,281,387 | B2 * | 10/2007 | Daddis, Jr. ..... | A47F 3/0408 165/110 |
| 7,640,970 | B2 | 1/2010 | Kim et al. | |
| 8,177,932 | B2 | 5/2012 | Becnel et al. | |
| 2010/0011804 | A1 | 1/2010 | Taras et al. | |
| 2010/0071868 | A1 | 3/2010 | Reifel et al. | |
| 2010/0263847 | A1 | 10/2010 | Alahyari et al. | |
| 2013/0186604 | A1 | 7/2013 | Geppert et al. | |
| 2013/0292104 | A1 * | 11/2013 | Park ..... | F28F 9/02 165/173 |
| 2013/0340451 | A1 | 12/2013 | Sapp et al. | |

FOREIGN PATENT DOCUMENTS

| | | | |
|---|---|---|---|
| EP | 1471321 | A1 | 10/2004 |
| WO | 2011154175 | A2 | 12/2011 |
| WO | 2012142070 | | 10/2012 |
| WO | 2014133394 | A1 | 9/2014 |
| WO | 2014133395 | A1 | 9/2014 |

OTHER PUBLICATIONS

Hydro, [online]; [retrieved on Dec. 5, 2017]; retrieved from the Internethttps://www.hydroextrusions.com/en-US/find-your-industry/hvacr/micro-channel-heat-exchangers/Hydro, "Superior Micro-Channel Heat Exchangers," 2017, pp. 1-5.
PCT ISR Written Opinion; International Application No. PCT/US2016/039854; International Filing Date: Jun. 28, 2016; dated Sep. 23, 2016, pp. 1-5.
PCT Notification of Transmittal of the International Search Report; International Application No. PCT/US2016/039854; International Filing Date: Jun. 28, 2016; dated Sep. 23, 2016, pp. 1-6.
Chinese Office Action and Search Report; Application No. 201680038855,0; dated Mar. 19, 2019; 8 pages.
Chinese Office Action; Application No. 201680038855.0; dated Dec. 18, 2019; 4 pages.
European Office Action; Application No. 16736721.8; dated Jan. 26, 2019; 6 pages.
European Office Action; Application No. 16736721.8; dated Oct. 1, 2018; 6 pages.
International Preliminary Report on Patentability; International Application No. PCT/US2016/039854; International Filing Date: Jun. 28, 2016; dated Jan. 2, 2018; 6 pages.
Chinese Office Action; International Application No. 201680038855.0; International Filing Date: Dec. 29, 2017; dated Apr. 15, 2019; 25 pages.
Chinese Office Action; International Application No. 201680038855.0; International Filing Date: Dec. 29, 2017; dated Mar. 16, 2020; 10 pages.
Chinese Office Action; International Application No. 201680038855.0; International Filing Date: Dec. 29, 2017; dated Nov. 15, 2019; 6 pages.
Decision on Rejection; International Application No. 201680038855.0; International Filing Date: Dec. 29, 2017; dated Aug. 18, 2020; 10 pages.

* cited by examiner

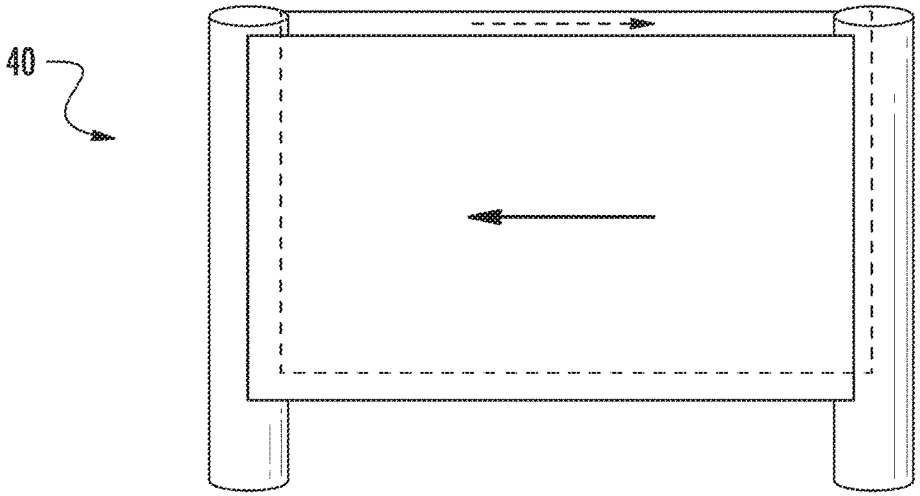
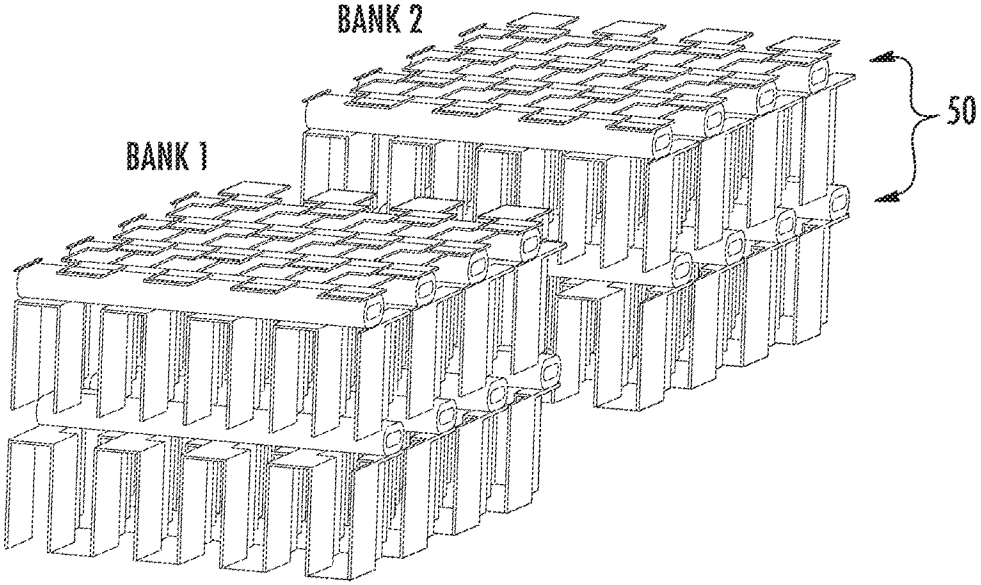
FIG. 8B
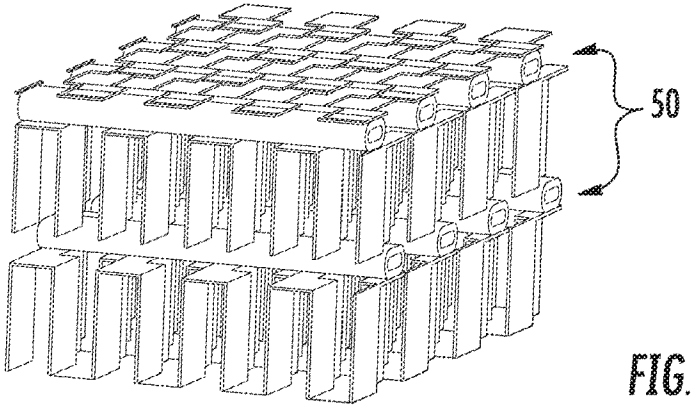

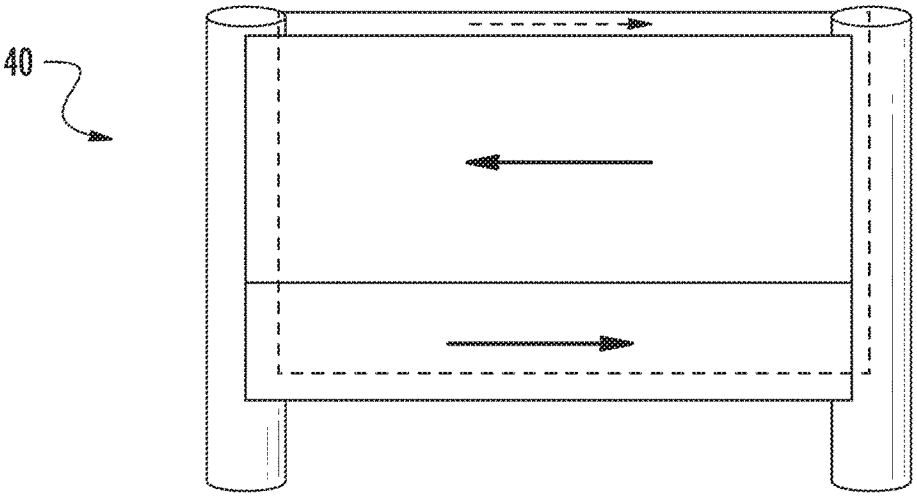
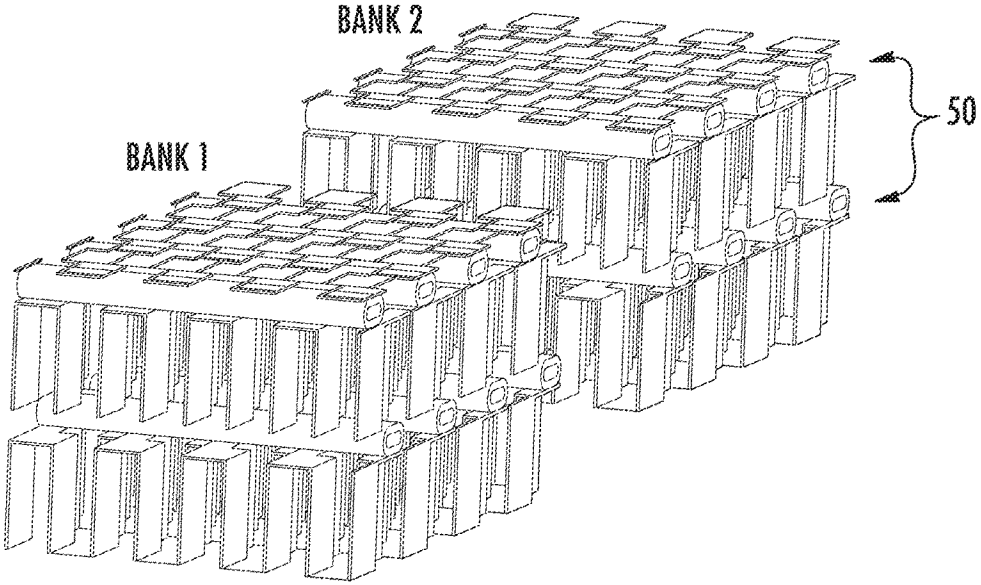
FIG. 8C
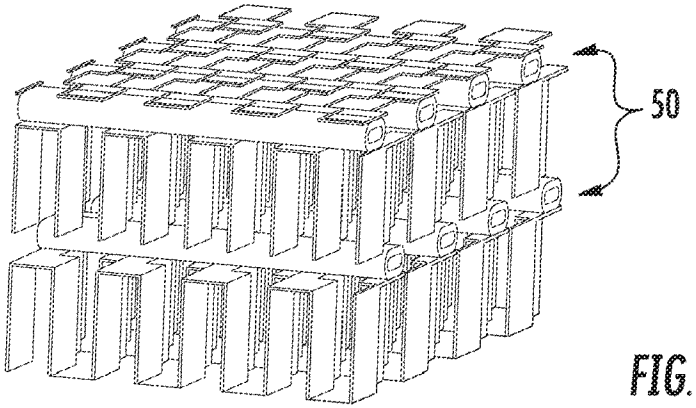

MICROTUBE HEAT EXCHANGER

CROSS REFERENCE TO RELATED APPLICATIONS

This application is a National Stage application of PCT/US2016/039854, filed Jun. 28, 2016, which claims the benefit of U.S. Provisional Application No. 62/186,111, filed Jun. 29, 2015, both of which are incorporated by reference in their entirety herein.

BACKGROUND

This disclosure relates generally to heat exchangers and, more particularly, to a heat exchanger having microtubes.

In recent years, much interest and design effort has been focused on the efficient operation of heat exchangers of refrigerant systems, particularly condensers and evaporators. A relatively recent advancement in heat exchanger technology includes the development and application of parallel flow (also referred to as microchannel or minichannel) heat exchangers as condensers and evaporators.

Microchannel heat exchangers are provided with a plurality of parallel heat exchange tubes, each of which has multiple flow passages through which refrigerant is distributed and flown in a parallel manner. The heat exchange tubes can be orientated substantially perpendicular to a refrigerant flow direction in the inlet, intermediate and outlet manifolds that are in flow communication with the heat exchange tubes.

SUMMARY

According to one embodiment, a heat exchanger is provided including an inlet manifold and an outlet manifold arranged generally parallel to the inlet manifold and being spaced therefrom by a distance. A plurality of rows of microtubes is aligned in a substantially parallel relationship. The plurality of rows of microtubes is configured to fluidly couple the inlet manifold and the outlet manifold. Each of the plurality of rows includes a plurality of microtubes.

In addition to one or more of the features described above, or as an alternative, in further embodiments the at least one microtube includes a first flattened surface and a second flattened surface.

In addition to one or more of the features described above, or as an alternative, in further embodiments a gap exists between at least a portion of adjacent microtubes within a row.

In addition to one or more of the features described above, or as an alternative, in further embodiments adjacent microtubes within one of the plurality of rows are not connected to one another.

In addition to one or more of the features described above, or as an alternative, in further embodiments adjacent microtubes within one of the plurality of rows are coupled to one another by at least one rib.

In addition to one or more of the features described above, or as an alternative, in further embodiments each of the plurality of rows has a same number of microtubes.

In addition to one or more of the features described above, or as an alternative, in further embodiments a flow passage of the microtube has a hydraulic diameter between about 0.2 mm and 1.4 mm.

In addition to one or more of the features described above, or as an alternative, in further embodiments a cross-sectional shape of one or more of the plurality of microtubes is generally airfoil shaped.

In addition to one or more of the features described above, or as an alternative, in further embodiments a cross-sectional shape of the plurality of microtubes is generally rectangular having rounded corners.

In addition to one or more of the features described above, or as an alternative, in further embodiments at least one heat transfer fin is arranged within an opening formed between adjacent rows of the plurality of rows of microtubes.

In addition to one or more of the features described above, or as an alternative, in further embodiments the plurality of microtubes includes a flattened surface, and a plurality of heat exchanger fins is configured to attach to the flattened surface of each of the plurality of microtubes within a row.

In addition to one or more of the features described above, or as an alternative, in further embodiments the plurality of heat exchanger fins configured to attach to each of the plurality of microtubes within a row is formed from a sheet such that the plurality of heat exchanger fins is connected.

In addition to one or more of the features described above, or as an alternative, in further embodiments the heat transfer fin is coupled to at least one microtube within a first row of the plurality of rows and at least one microtube within a second row of the plurality of rows.

In addition to one or more of the features described above, or as an alternative, in further embodiments said at least one heat transfer fin is serrated.

In addition to one or more of the features described above, or as an alternative, in further embodiments said at least one heat transfer fin is louvered.

In addition to one or more of the features described above, or as an alternative, in further embodiments the plurality of rows of microtubes are formed in a first tube bank and a second tube bank. The first tube bank and the second tube bank are disposed behind one another relative to a direction of flow of a second heat transfer fluid through the heat exchanger.

According to another embodiment, a heat exchanger system is provided including a plurality of microtubes aligned in substantially parallel relationship and fluid connected by a manifold system. Each of the plurality of microtubes defines a flow passage wherein the plurality of microtubes are arranged in rows and at least a portion of the plurality of microtubes within a row are separate from one another by a distance such that a gap exists.

In addition to one or more of the features described above, or as an alternative, in further embodiments a gap exists between each of the plurality of microtubes.

In addition to one or more of the features described above, or as an alternative, in further embodiments adjacent microtubes are connected by at least one rib extending there between.

In addition to one or more of the features described above, or as an alternative, in further embodiments at least a portion of the plurality of microtubes within a row is arranged in multiple groups such that the gap exists between adjacent groups of microtubes.

In addition to one or more of the features described above, or as an alternative, in further embodiments each of the plurality of microtubes arranged within a group is integrally formed.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

FIGS. 8*a*-8*c* are sectioned views of examples of heat exchangers having varying flow path configurations.

The detailed description explains embodiments of the present disclosure, together with advantages and features, by way of example with reference to the drawings.

DETAILED DESCRIPTION

Problems may occur when using a conventional microchannel heat exchanger within a refrigerant system. As a result of their higher surface density and flat tube construction, microchannel heat exchangers can be susceptible to moisture retention and subsequent frost accumulation. This can be particularly problematic in heat exchangers having horizontally oriented heat exchanger tubes because water collects and remains on the flat, horizontal surfaces of the tubes. This results not only in greater flow and thermal resistance but also corrosion and pitting on the tube surfaces.

Figure 1:
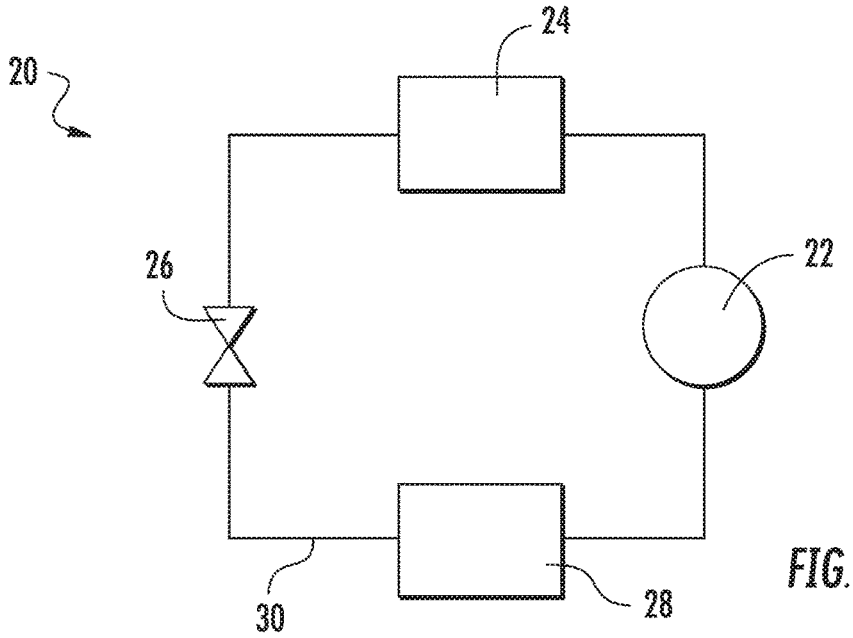
FIG. 1 is an example of a conventional vapor compression system.

Referring now to FIG. 1, an example of a basic refrigerant system 20 is illustrated and includes a compressor 22, condenser 24, expansion device 26, and evaporator 28. The compressor 22 compresses a refrigerant and delivers it downstream into a condenser 24. From the condenser 24, the refrigerant passes through the expansion device 26 into an inlet refrigerant pipe 30 leading to the evaporator 28. From the evaporator 28, the refrigerant is returned to the compressor 22 to complete the closed-loop refrigerant circuit.

Figure 2:
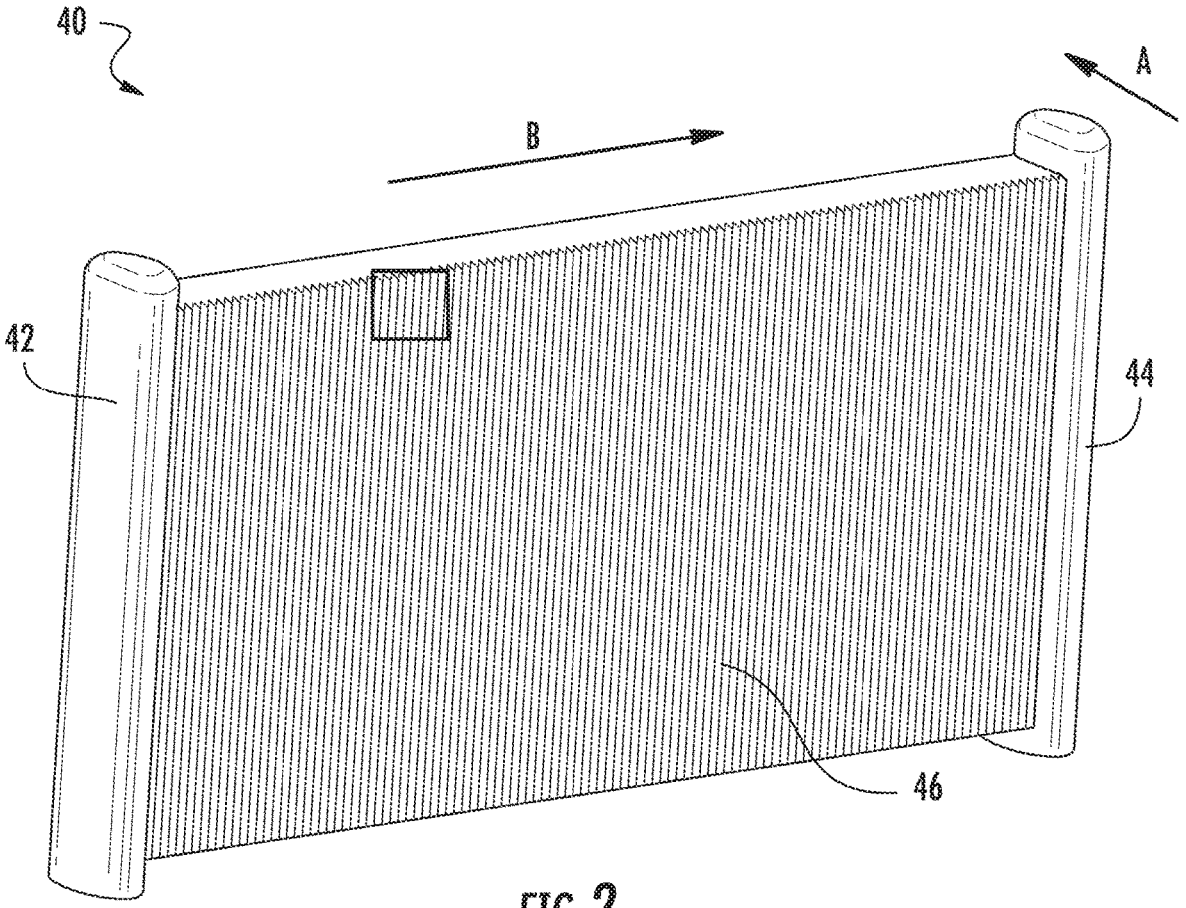
FIG. 2 is a perspective view of a parallel flow heat exchanger according to an embodiment of the present disclosure.

Referring now to FIG. 2, an example of a heat exchanger 40, for example configured for use as either a condenser 24 or an evaporator 28 in refrigerant system 20, is illustrated. As shown, the heat exchanger 40 includes a first manifold 42, a second manifold 44 spaced apart from the first manifold 42, and a plurality of heat exchange microtubes 46 extending generally in a spaced, parallel relationship between the first manifold 42 and the second manifold 44. It should be understood that other orientations of the heat exchange microtubes 46 and respective manifolds 42, 44 are within the scope of the present disclosure. Furthermore, bent heat exchange microtubes and/or bent manifolds are also within the scope of the present disclosure.

Figure 7:
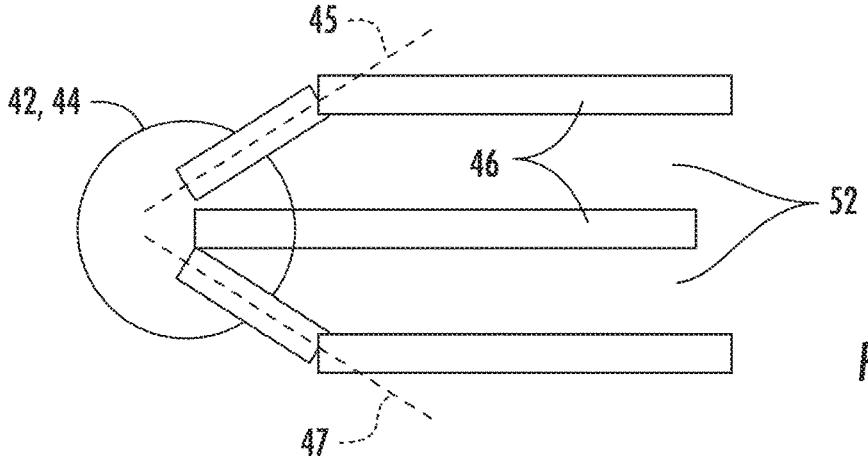
FIG. 7 is a cross-sectional view of a header of a parallel flow heat exchanger.

As shown, the manifolds 42, 44, comprise vertically elongated, generally hollow, closed end cylinders having a circular cross-section (see FIG. 7). However, manifolds 42, 44 having other configurations, such as a semi-circular, semi-elliptical, square, rectangular, or other cross-section for example, are within the scope of the present disclosure.

A first heat transfer fluid, such as a liquid, gas, or two phase mixture of refrigerant for example, is configured to flow through the plurality of heat exchanger microtubes 46. While the term "first fluid" is utilized in the application, it should be understood that any selected fluid may flow through the plurality of microtubes 46 for the purpose of heat transfer. In the illustrated, non-limiting embodiment, the plurality of microtubes 46 are arranged such that a second heat transfer fluid, for example air, is configured to flow across the plurality of microtubes 46, such as within a space 52 defined between adjacent microtubes 46 for example. As a result, thermal energy is transferred between the first fluid and the second fluid via the microtubes 46.

The illustrated, non-limiting embodiment of a heat exchanger 40 in FIG. 2 has a single-pass flow configuration. For example, the first heat transfer fluid is configured to flow from the first manifold 42 to the second manifold 44 through the plurality of heat exchanger microtubes 46 in the direction indicated by arrow B. To form a multi-pass flow configuration, at least one of the first manifold 42 and the second manifold 44 includes two or more fluidly distinct chambers. The fluidly distinct chambers may be formed by coupling separate manifolds together, or alternatively, by positioning a baffle or divider plate (not shown) within at least one of the manifolds 42, 44. In addition, although the heat exchanger 40 is illustrated as having only a single tube bank, other configurations having multiple tube banks disposed one behind another relative to the flow of the second heat transfer fluid are within the scope of the present disclosure. In one embodiment, a heat exchanger 40 having multiple tube banks may be formed by forming one or more bends in the plurality of heat exchanger microtubes 46.

Figure 3:
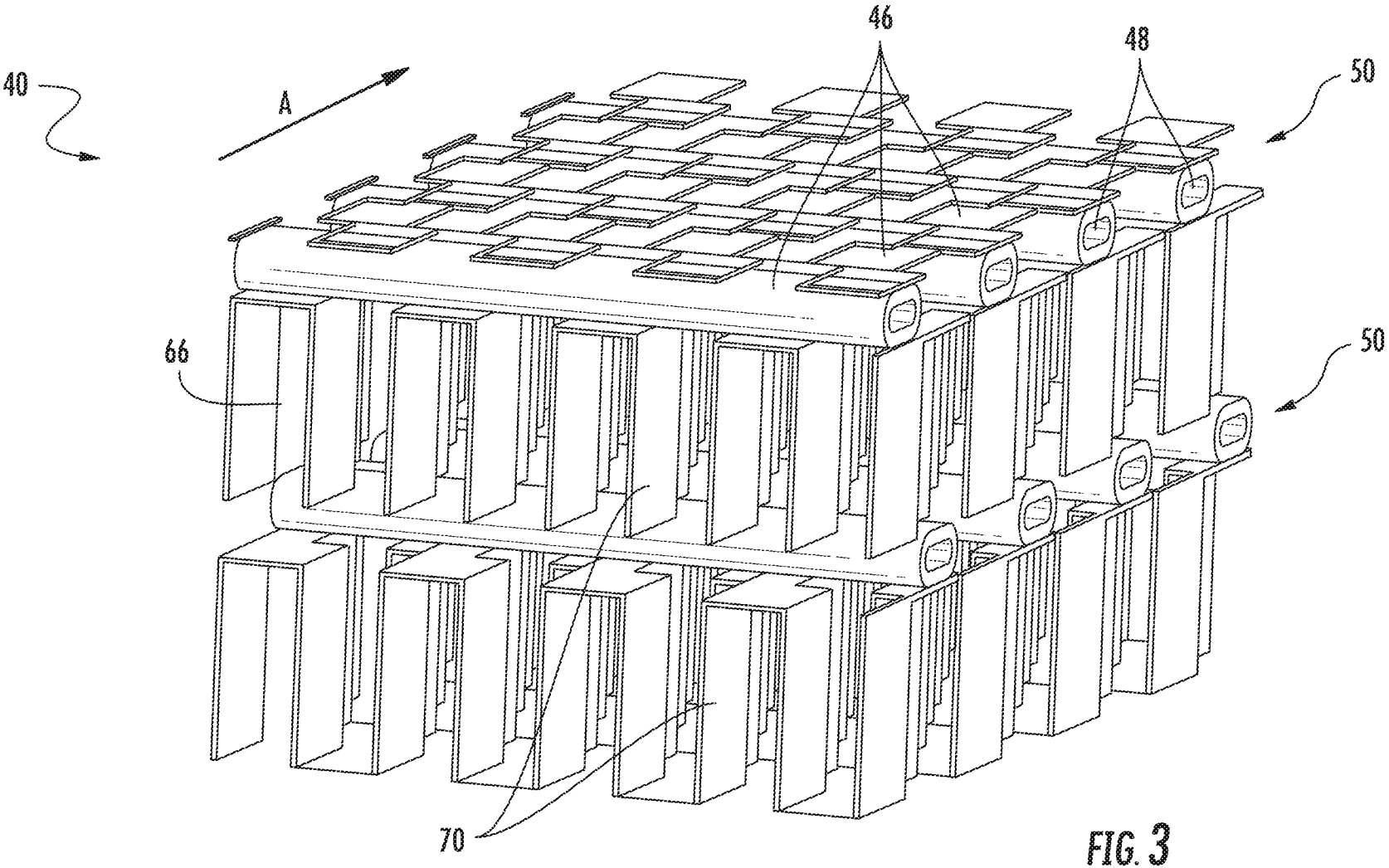
FIG. 3 is a detailed perspective view of a plurality of heat exchanger tubes of a parallel flow heat exchanger.

Referring now to FIG. 3, the heat exchanger microtubes 46 are illustrated in more detail. As shown, the heat exchanger microtubes 46 have a substantially hollow interior 48 configured to define a flow passage for a heat transfer fluid. As used herein, the term "microtube" refers to a heat exchanger tube having a hydraulic diameter between about 0.2 mm to 1.4 mm, and more specifically, between about 0.4 mm and 1 mm. A wall thickness of the microtubes 46 may be between about 0.05 mm and 0.4 mm depending on the method of manufacture. In one embodiment, extruded microtubes 46 may generally have a wall thickness of about 0.3 mm for example. A cross-sectional shape of the microtubes 46 is selected to improve heat transfer between a second heat transfer fluid flowing about the exterior of the microtubes 46 in the direction indicated by arrow A and the first heat transfer fluid flowing through the interior of the plurality of microtubes 46. In the illustrated, non-limiting embodiment, the cross-sectional shape of the outside perimeter of the heat exchanger microtubes 46 is generally rectangular and includes rounded corners. However, it should be appreciated that the microtubes 46 may be constructed having any of a variety of cross-sectional shapes. For example, the cross-sectional shape of the outside perimeter can include but is not limited to a circular, elliptical, rectangular, triangular, or airfoil shape. The shape of the microtubes 46 may be configured to reduce the wake size behind each of the microtubes 46, which decreases pressure drop and improves heat transfer.

Figure 5A:
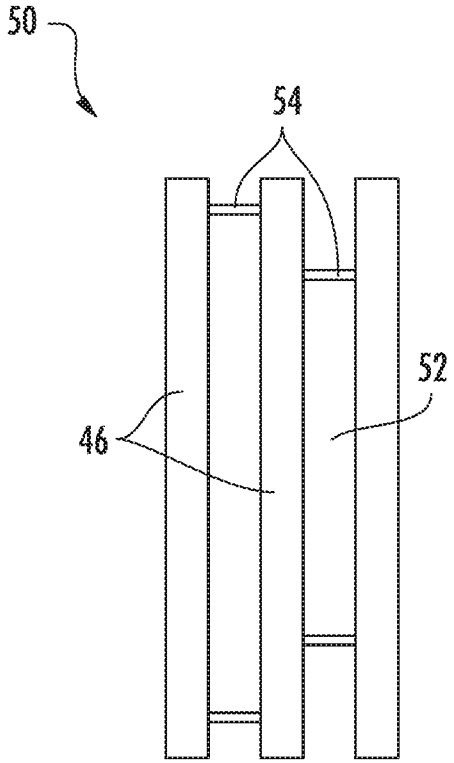
FIGS. 5*a* and 5*b* are top views of heat exchanger tubes of a parallel flow heat exchanger having varying configurations.
Figure 5B:
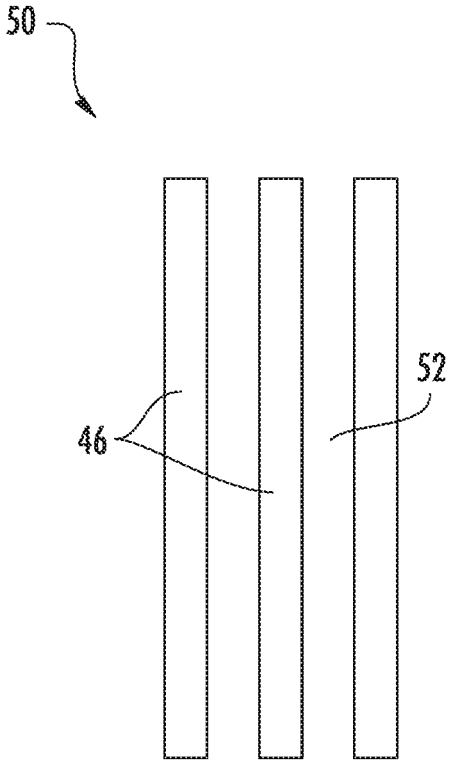

The heat exchanger microtubes 46 are arranged in a plurality of rows 50 such that each row 50 comprises one or more heat exchanger microtubes 46. In embodiments where the rows 50 have multiple heat exchange microtubes 46, each row 50 may have the same, or alternatively, a different number of heat exchange microtubes 46. The heat exchange microtubes 46 within a row 50 are arranged substantially parallel to one another. As used herein, the term "substantially parallel" is intended to cover configurations where the heat exchanger microtubes 46 within a row 50 are not perfectly parallel, such as due to variations in straightness between microtubes 46 for example. With reference to FIGS. 5*a*-5*b*, at least a portion of adjacent microtubes 46 within a layer 50 are separated from one another by a distance such that a gap 52 exists between the microtubes 46 allowing a fluid, such as water condensate for example, to flow there through. In one embodiment, the microtubes 46 may be completely separate from one another, as shown in FIG. 5*b*. Alternatively, as shown in FIG. 5*a*, one or more ribs 54 may extend between adjacent heat exchange microtubes 46. The ribs can provide stability to the layer 50 and/or can simplify manufacturing. The ribs 54 extending between adjacent heat exchange microtubes 46 may, but need not be substantially aligned with one another.

Figure 6:
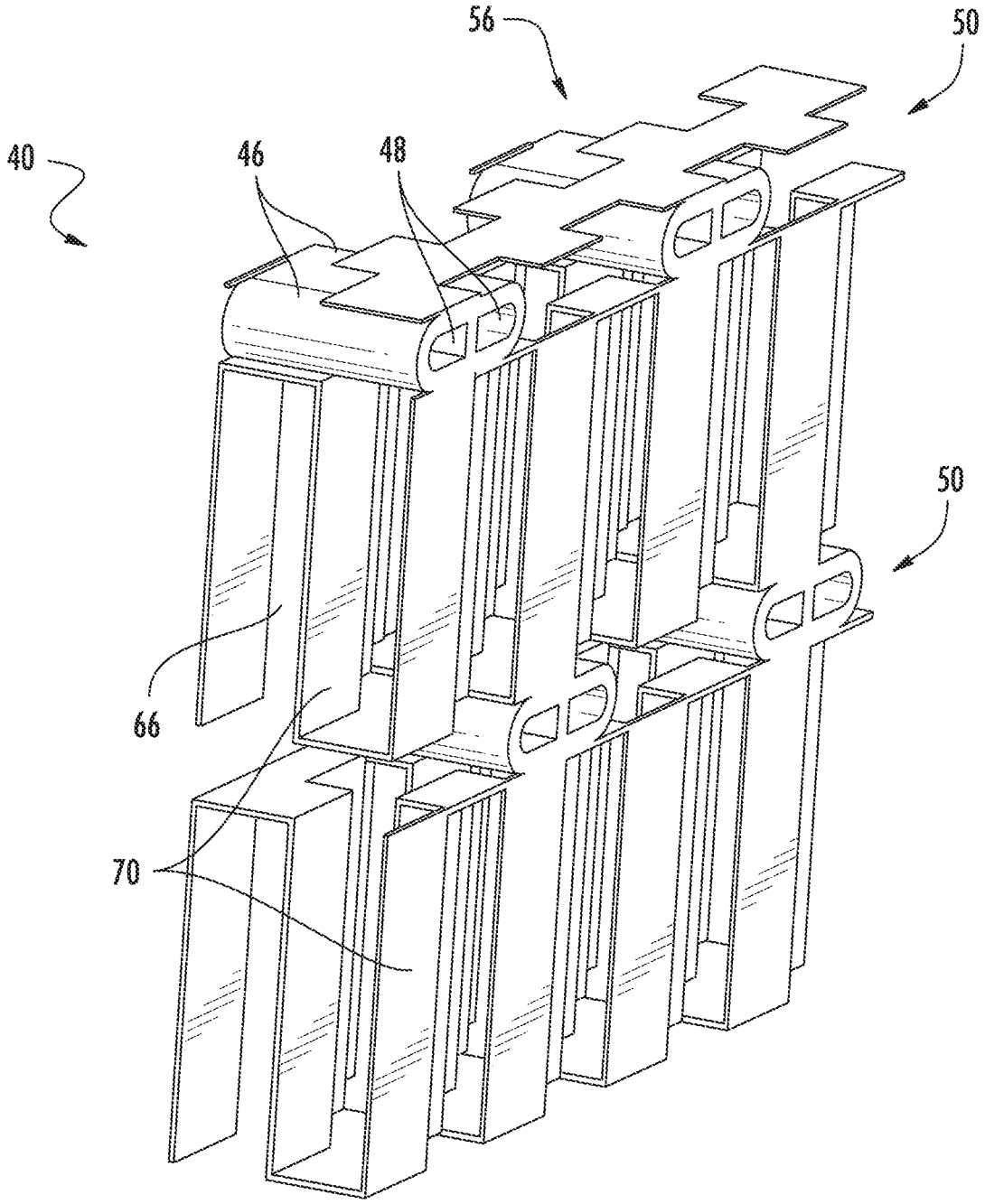
FIG. 6 is a detailed perspective view of another configuration of a plurality of heat exchanger tubes of a parallel flow heat exchanger.

In yet another embodiment, shown in FIG. 6, the plurality of heat exchanger microtubes 46 within each row 50 may be formed into groups 56, each group 56 consisting of two or more integrally formed heat exchanger microtubes 46. Alternatively, the hollow interior 46 of one or more of the heat exchanger microtubes 46 may be divided to form multiple parallel flow channels within a single heat exchanger microtube 46. At least partial separation between adjacent heat exchanger microtubes 46 or adjacent groups 56 of heat exchanger microtubes 46, however, is generally maintained over a width of the heat exchanger 40.

Figure 4:
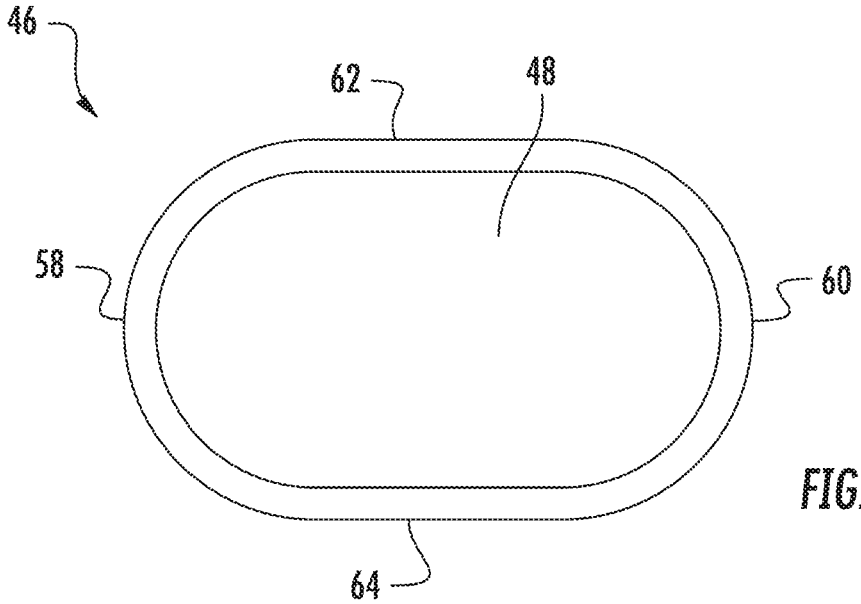
FIG. 4 is a cross-sectional view of one of the plurality of heat exchanger tubes of a parallel flow heat exchanger.

With reference now to FIG. 4, each heat exchange microtube 46 has a leading edge 58 and a trailing edge 60. The leading edge 58 of each heat exchanger microtube 46 is disposed upstream of its respective trailing edge 60 with respect to a flow of a second heat transfer fluid (e.g. air) A through the heat exchanger 40. The microtubes 46 may additionally include a first flattened surface 62 and a second, opposite flattened surface 64 to which one or more heat transfer fins 70 (see FIGS. 3 and 6) may be attached.

Referring again to FIG. 3, a plurality of heat transfer fins 70 may be disposed between and rigidly attached, such as by a furnace braze process for example, to the flattened surfaces 62, 64 (FIG. 4) of the heat exchange microtubes 46 to enhance external heat transfer and provide structural rigidity to the heat exchanger 40. By forming the heat exchanger microtubes 46 with flattened surfaces 62, 64, the contact area between the microtubes 46 and the heat transfer fins 70 is increased which not only improves heat transfer between the microtubes 46 and the fins 70, but also makes the connection between the microtubes 46 and the fins 70 easier to form.

The fins 70 may be formed as layers arranged within the space 66 between adjacent rows 50 of heat exchanger microtubes 46 such that each fin layer is coupled to at least one of the plurality of microtubes 46 within the surrounding rows 50. In an embodiment illustrated in FIG. 3, the fins 70 are lanced or serrated. However, fins 70 of other constructions, such as plain, louvered, or otherwise enhanced are also within the scope of the present disclosure. Inclusion of the plurality of fins 70 provides additional secondary heat transfer surface area where the fins 70 are in direct contact with the adjacent second heat transfer fluid flowing in the direction A.

The parameters of both the heat exchanger microtubes 46 and the fins 70 may be optimized based on the application of the heat exchanger 40. Accordingly, the heat exchanger 40 provides a significant reduction in both material and refrigerant volume compared to conventional microchannel heat exchangers, while allowing condensate to drain between adjacent heat exchanger microtubes 46 and through openings formed in the fins 70. In addition, as shown in FIG. 7, the microtube design allows for flexibility in the spatial arrangement between adjacent microtubes 46 along their length. For example, flow axes 45 and 47 of a plurality of microtubes 46 can converge within a manifold 42, 44 (e.g., the microchannel tubes 46 can be non-parallel along portions of the heat exchanger). In comparison, the spatial arrangement between microchannels in a multiport microchannel tubes can be fixed (e.g., such as when the multiport tube is extruded with a fixed cross-section and thus a fixed channel spacing). Thus, in at least this way, the manifolds 42, 44 can be made smaller, the space 52 can be made larger, the distance that the microtubes 46 extend into the manifold can be reduced, or a combination including at least one of the foregoing can be realized in comparison to multiport microchannel tubes (e.g., flat multiport tubes) which can correspondingly yield a reduction in the overall size of the heat exchanger 40.

Figure 8A:
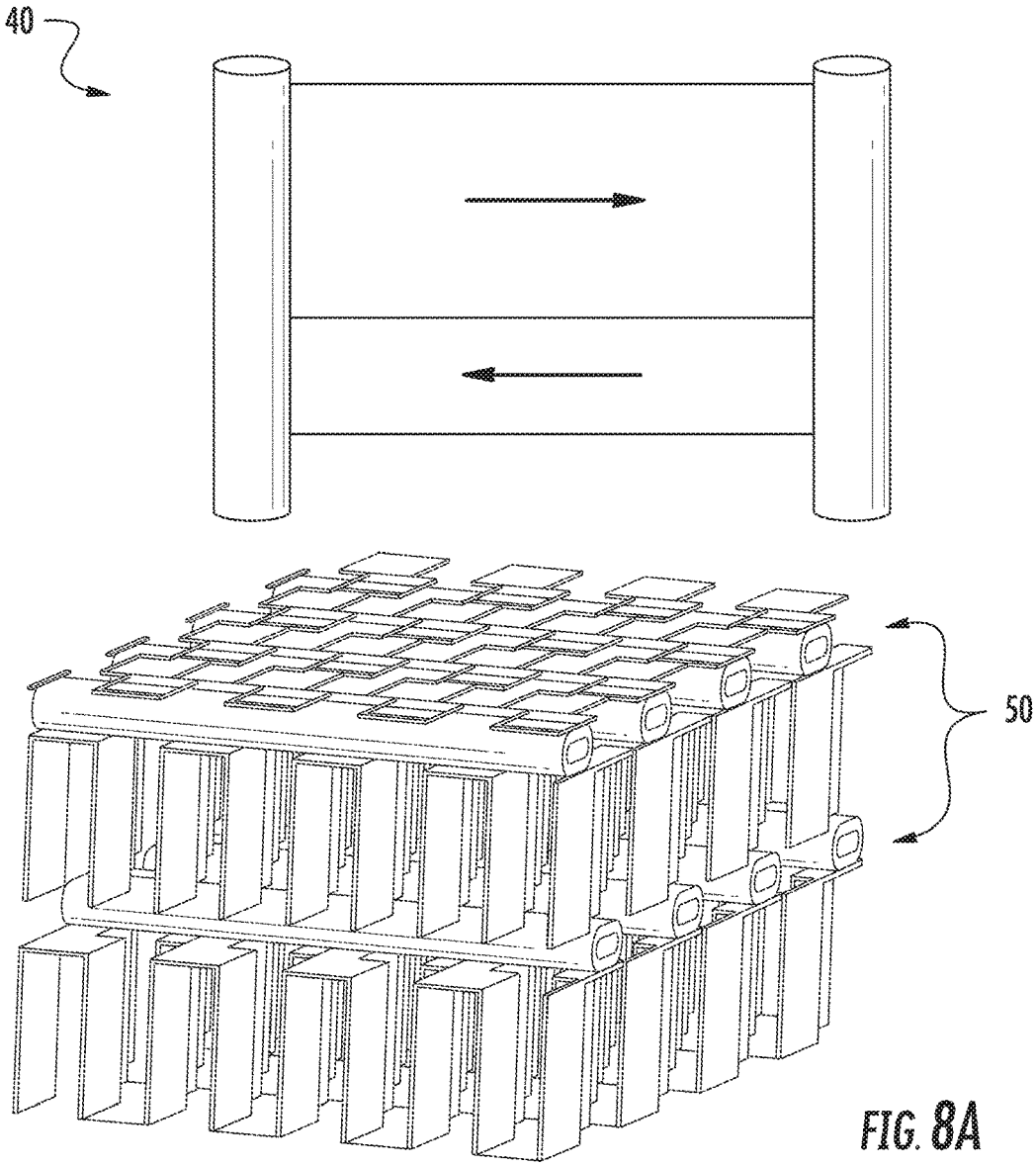

With reference now to FIGS. 8*a*-8*c*, the heat exchanger 40 may be adapted in a variety of ways to achieve a multi-pass flow configuration. For example, as shown in FIG. 8*a*, one or more of the rows 50 of heat exchanger microtubes 46 are configured to receive a flow in a first direction and one or more of the rows 50 of heat exchanger microtubes 46 are configured to receive a flow in a second, opposite direction. More specifically, the same number of microtubes 46 per row dedicated to each flow pass, may, but need not be equal. In FIG. 8*b*, aligned rows 50 within adjacent tube banks of a heat exchanger 40 may have different flow configurations. Alternatively, heat exchanger microtubes 46 within the same row 50 may have different flow configurations (FIGS. 8*b* and 8*c*). The flow configurations illustrated herein are intended as examples only, and other configurations are within the scope of the disclosure. In addition, the illustrated and described flow configurations are described with respect to a heat exchanger 40 having a single tube bank; however the circuiting possibilities for a heat exchanger 40 having a plurality of tube banks are infinite.

Embodiment 1

A heat exchange comprising: an inlet manifold; an outlet manifold arranged generally parallel to the inlet manifold, the outlet manifold being separated from the inlet manifold by a distance; and a plurality of rows of microtubes aligned in substantially parallel relationship, the plurality of rows of microtubes being configured to fluidly couple the inlet manifold and the outlet manifold, wherein each of the plurality of rows includes a plurality of microtubes.

Embodiment 2

The heat exchanger according to embodiment 1, wherein the at least one microtube includes a first flattened surface and a second flattened surface.

Embodiment 3

The heat exchanger according to embodiment 1 or embodiment 2, wherein a gap exists between at least a portion of adjacent microtubes within a row.

Embodiment 4

The heat exchanger according to any of embodiments 1-3, wherein adjacent microtubes within one of the plurality of rows are not connected to one another.

Embodiment 5

The heat exchanger according to any of embodiments 1-4, wherein adjacent microtubes within one of the plurality of rows are coupled to one another by at least one rib.

Embodiment 6

The heat exchanger according to any of embodiments 1-5, wherein each of the plurality of rows has a same number of microtubes.

Embodiment 7

The heat exchanger according to any of embodiments 1-6, wherein a flow passage of the microtube has a hydraulic diameter between about 0.2 mm and 1.4 mm.

Embodiment 8

The heat exchanger according to any of embodiments 1-7, wherein a cross-sectional shape of one or more of the plurality of microtubes is generally airfoil shaped.

Embodiment 9

The heat exchanger according to any of embodiments 1-8, wherein a cross-sectional shape of the plurality of microtubes is generally rectangular having rounded corners.

Embodiment 10

The heat exchanger according to any of embodiments 1-9, wherein at least one heat transfer fin is arranged within an opening formed between adjacent rows of the plurality of rows of microtubes.

Embodiment 11

The heat exchanger according to any of embodiments 1-10, wherein the plurality of microtubes includes a flattened surface, and a plurality of heat exchanger fins is configured to attach to the flattened surface of each of the plurality of microtubes within a row.

Embodiment 12

The heat exchanger according to embodiment 11, wherein the plurality of heat exchanger fins configured to attach to each of the plurality of microtubes within a row is formed from a sheet such that the plurality of heat exchanger fins is connected.

Embodiment 13

The heat exchanger according to embodiment 11 or embodiment 12, wherein the heat transfer fin is coupled to at least one microtube within a first row of the plurality of rows and at least one microtube within a second row of the plurality of rows.

Embodiment 14

The heat exchanger according to any of embodiments 11-13 wherein said at least one heat transfer fin is serrated.

Embodiment 15

The heat exchanger according to any of embodiments 11-13 wherein said at least one heat transfer fin is louvered.

Embodiment 16

The heat exchanger according to any of embodiments 1-16 wherein the plurality of rows of microtubes are formed in a first tube bank and a second tube bank, the first tube bank and the second tube bank being disposed behind one another relative to a direction of flow of a second heat transfer fluid through the heat exchanger.

Embodiment 17

A heat exchanger system comprising: a parallel flow heat exchanger including a plurality of microtubes aligned in substantially parallel relationship and fluidly connected by a manifold system, each of the plurality of microtubes defines a flow passage, wherein the plurality of microtubes are arranged in rows and at least a portion of the plurality of microtubes within a row are separated from one another by a distance such that a gap exists there between.

Embodiment 18

The heat exchanger system according to embodiment 17, wherein a gap exists between each of the plurality of microtubes.

Embodiment 19

The heat exchanger system according to embodiment 18, wherein adjacent microtubes are connected by at least one rib extending there between.

Embodiment 20

The heat exchanger system according to embodiment 17, wherein at least a portion of the plurality of microtubes within a row is arranged in multiple groups such that the gap exists between adjacent groups of microtubes.

Embodiment 21

The heat exchanger system according to embodiment 20, wherein each of the plurality of microtubes arranged within a group is integrally formed.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate in spirit and/or scope. Additionally, while various embodiments have been described, it is to be understood that aspects of the present disclosure may include only some of the described embodiments. Accordingly, the present disclosure is not to be seen as limited by the foregoing description, but is only limited by the scope of the appended claims.

We claim:

1. A heat exchanger comprising:

an inlet manifold;

an outlet manifold arranged generally parallel to the inlet manifold, the outlet manifold being separated from the inlet manifold by a distance; and a plurality of microtubes configured to fluidly couple the inlet manifold and the outlet manifold, each of the plurality of microtubes having at least one flow channel;

wherein the plurality of microtubes are arranged within a plurality of rows, and the microtubes within at least one row of the plurality of rows are substantially parallel;

wherein the at least one microtube of the plurality of microtubes includes a first flattened surface and a second flattened surface, and a gap exists between at least a portion of adjacent microtubes within a row;

wherein a plurality of heat exchanger fins is configured to attach to at least one of the flattened surfaces of each of the plurality of microtubes within a row;

wherein a cross-sectional shape of each of the plurality of microtubes is generally rectangular having rounded corners;

wherein the microtubes within at least one of the plurality of rows are formed into a plurality of distinct groups of microtubes, each of the plurality of groups of microtubes including at least two integrally formed microtubes, with at least partial separation between the groups of microtubes.

2. The heat exchanger according to claim 1, wherein adjacent microtubes within one of the plurality of rows are not connected to one another.

3. The heat exchanger according to claim 1, wherein adjacent microtubes within one of the plurality of rows are coupled to one another by at least one rib.

4. The heat exchanger according to claim 1, wherein each of the plurality of rows has a same number of groups of microtubes.

5. The heat exchanger according to claim 1, wherein each flow channel has a hydraulic diameter between about 0.2 mm and 1.4 mm.

6. The heat exchanger according to claim 1, wherein at least one heat transfer fin is arranged within an opening formed between adjacent rows of the plurality of rows of microtubes.

7. The heat exchanger according to claim 1, wherein the plurality of heat exchanger fins configured to attach to each of the plurality of microtubes within a row is formed from a sheet such that the plurality of heat exchanger fins is connected.

8. The heat exchanger according to claim 1, wherein each heat exchanger fin is coupled to at least one microtube within a first row of the plurality of rows and at least one micro tube within a second row of the plurality of rows.

9. The heat exchanger according to claim 1, wherein each of the said at least one heat exchanger fin is serrated.

10. The heat exchanger according to claim 1, wherein each of the said at least one heat exchanger fin is louvered.

11. The heat exchanger according to claim 1, wherein the plurality of rows of microtubes are formed in a first tube bank and a second tube bank, the first tube bank and the second tube bank being disposed one behind another relative to a direction of flow of a second heat transfer fluid through the heat exchanger.

* * * * *